United States Patent [19]

Maynard, Jr.

[11] Patent Number: 4,583,668

[45] Date of Patent: Apr. 22, 1986

[54] POURING SPOUT FOR DIVERSE LIQUID CONTAINERS

[76] Inventor: Walter P. Maynard, Jr., Rte. 8, Cumming, Ga. 30130

[21] Appl. No.: 658,308

[22] Filed: Oct. 5, 1984

[51] Int. Cl.[4] ..... B65D 25/48; B65D 47/14; B65D 23/12

[52] U.S. Cl. ..... 222/529; 222/543; 222/546; 222/568; 285/177; 285/12; 141/367; 141/368; 215/319; 215/100 R; 220/85 SP; 220/287

[58] Field of Search ..... 222/568, 567, 538, 539, 222/529, 543, 546; 220/85 SP, 287; 215/319, 100 R; 285/177, 12; 141/382–388, 363–368, 319–321, 279, 392

[56] References Cited

U.S. PATENT DOCUMENTS 2,556,627 6/1951 Miksis ..... 222/568

FOREIGN PATENT DOCUMENTS 0262301 5/1960 Australia ..... 222/568
0827393 1/1952 Fed. Rep. of Germany ..... 222/539

*Primary Examiner*—Joseph J. Rolla
*Assistant Examiner*—Louise S. Heim
*Attorney, Agent, or Firm*—William H. Needle

[57] ABSTRACT

A threaded elongated flexible pouring spout is detachably connectable with the threaded outlets of variously sized liquid containers by means of a multi-threaded adapter having threaded sleeve portions of different diameters, one of which at each end of the adapter is engageable with the threads of the flexible spout. A threaded extension cap for the flexible spout enables the servicing of small openings requiring liquids. The extension cap can also be threadedly engaged with the outlets of certain containers.

7 Claims, 9 Drawing Figures

POURING SPOUT FOR DIVERSE LIQUID CONTAINERS

BACKGROUND OF THE INVENTION

The objective of the present invention is to provide a pouring spout assembly which can be utilized with a relatively large number of commercial liquid containers, such as plastic bottles whose threaded outlets differ in diameter through a range of standard diameters.

The threaded outlets of plastic bottles in wide use for storing and dispensing motor oil, anti-freeze, transmission fluid and the like have nominal diameters of 28 MM, 38 MM and 43 MM. Heretofore, no universally adaptable pouring spout for these diverse sizes of outlets has been commercially available, resulting in considerable inconvenience to users of the liquid containers, as well as spillage caused by haphazard pouring spout arrangements or dispensing of liquids from the containers without the aid of a spout.

In accordance with the present invention, a "one spout fits all bottles" solution to the above problem of the prior art is provided. An elongated flexible pouring spout has a threaded terminal at one end which is engageable in a center threaded sleeve at either end of a double-ended threaded adapter. Additional coaxial concentric threaded sleeves of diverse diameters surround the center threaded sleeve and enable connecting the adapter to threaded outlets of various containers, which outlets differ in their standard diameters. A threaded extension cap for the leading end of the pouring spout is provided to enable the delivery of liquid into small openings of transmissions and the like. The extension cap can also be received on threaded container outlets of one standard diameter.

Other features and advantages of the invention will become apparent during the course of the following description.

BRIEF DESCRIPTION OF THE DRAWING FIGURES

DETAILED DESCRIPTION

Figure 1:
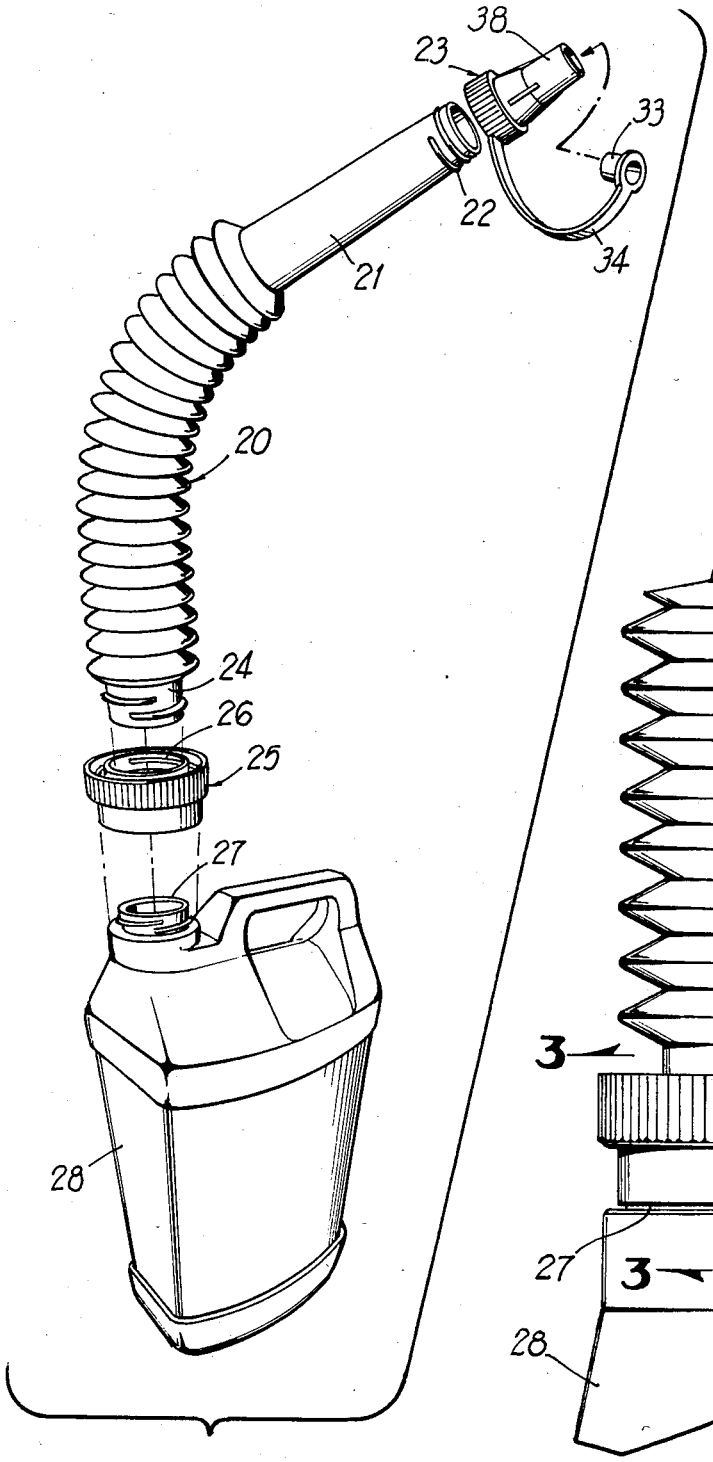
FIG. 1 is an exploded perspective view of a pouring spout according to the present invention associated with a liquid container of one type and size.

Referring to the drawings in detail, wherein like numerals designate like parts, an elongated flexible pouring spout 20 terminates at its forward end in a somewhat tapered relatively short rigid extension 21 having a screw-threaded terminal 22 adapted to receive detachably a threaded extension cap 23, to be further described. At its rear end, the flexible spout 20 has another threaded terminal 24 adapted for connection with either end of a double-ended multi-threaded adapter 25 comprising the essence of the invention. The adapter 25 has a center internally threaded sleeve 26 extending entirely through the adapter and defining its opposite end faces. The threaded sleeve 26 is of a diameter, such as 28 MM, to enable it to be threadedly coupled with the threaded terminal 24 of pouring spout 20 and/or with the threaded outlet 27 of a liquid container 28 whose outlet 27 is also 28 MM in diameter.

Additionally, the adapter 25 at each end includes an outer enlarged diameter internally threaded sleeve portion 29 and 30. These sleeve portions are coaxial and concentric with the center sleeve 26 and surround the latter. All of the sleeve portions 26, 29 and 30 are integrally joined by a transverse median wall 31 having a central smooth cylindrical liquid conduit element 32 whose ends lie inwardly of the end faces of the adapter 25, the element 32 being of smaller diameter than the center threaded sleeve 26 and being in spaced concentric relationship therewith.

The diameter of the outer sleeve 29 may be 43 MM while the diameter of the outer sleeve portion 30 may be 38 MM. The several diameters of the threaded sleeve portions of the adapter 25 represent the range of diameters encompassed by the threaded outlets of the most commonly used plastic bottles or containers for such liquids as motor oil, anti-freeze, transmission fluid and others. Thus, the invention provides a pouring spout assembly which is universal in its applicability to any and all of these most commonly encountered threaded container outlets, such as the outlet 27 in FIG. 1.

The double-ended adapter 25 is easily reversed end-for-end for coupling with the threaded outlet 27, etc. having any of the standard diameters, 28 MM, 38 MM and 43 MM. In any position of use, the center threaded sleeve 26 at either end can be coupled with the 28 MM threaded terminal 24 of the flexible spout 20 since the center sleeve 26 has the same diameter on either side of the wall 31.

Figure 2:
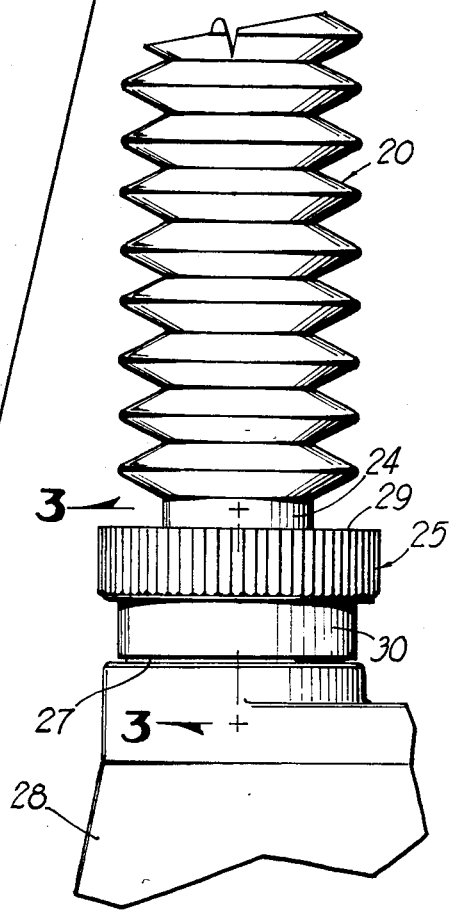
FIG. 2 is a fragmentary side elevation of the pouring spout in assembled relationship with the container shown in FIG. 1.
Figure 3:
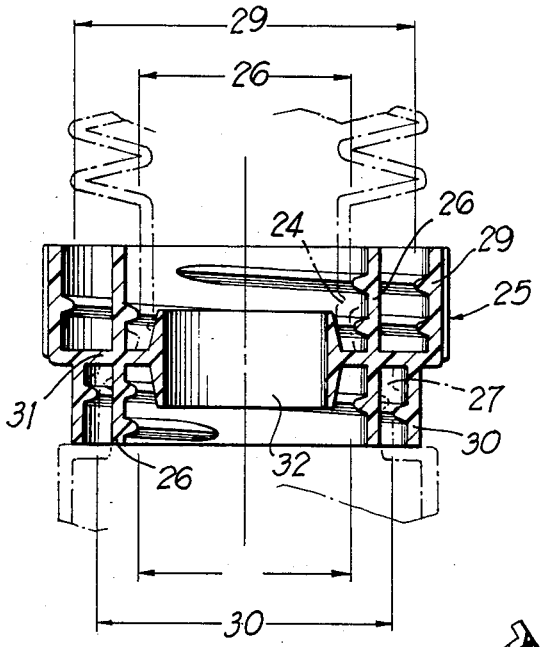
FIG. 3 is an enlarged central vertical section through a double-ended threaded adapter taken on line 3—3 of FIG. 2, the flexible spout and container being shown in phantom lines.
Figure 5:
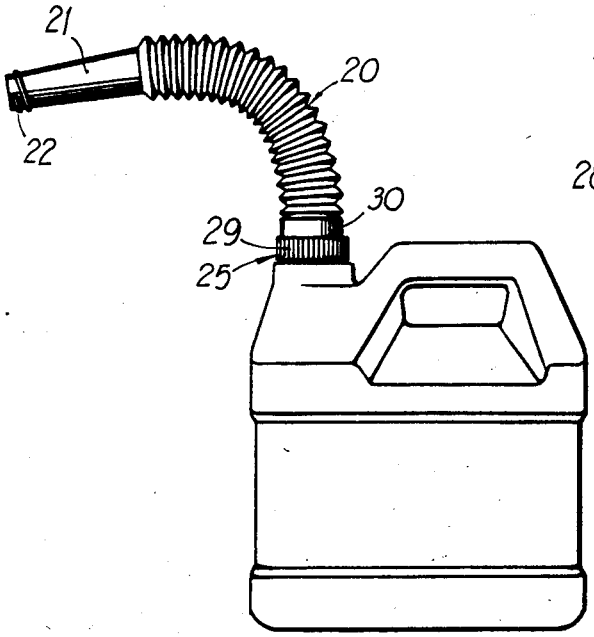
FIGS. 5, 6, 7, 8 and 9 are side elevational views of the invention in use with diverse sizes and types of liquid containers.
Figure 6:
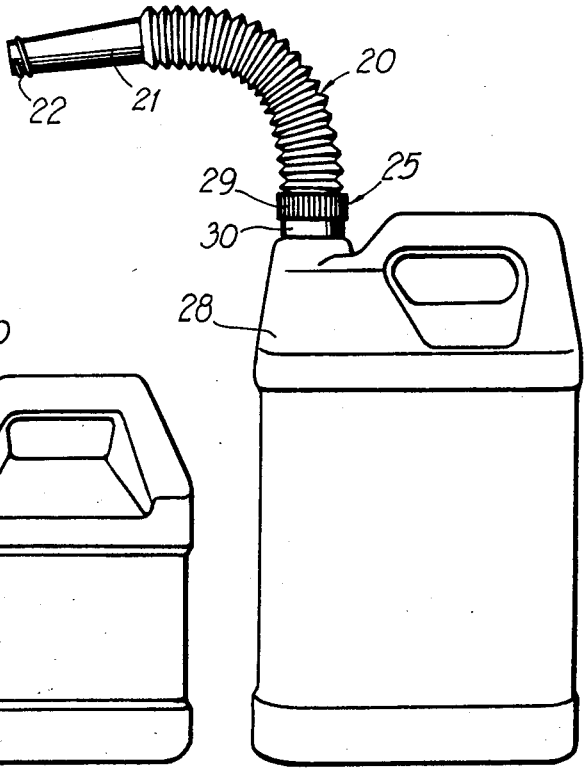
Figure 7:
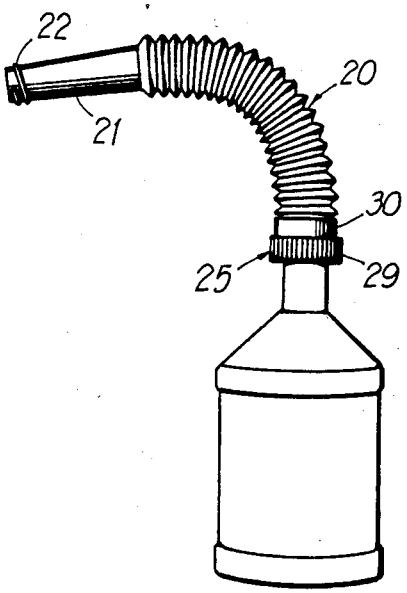
Figures 8, 9:
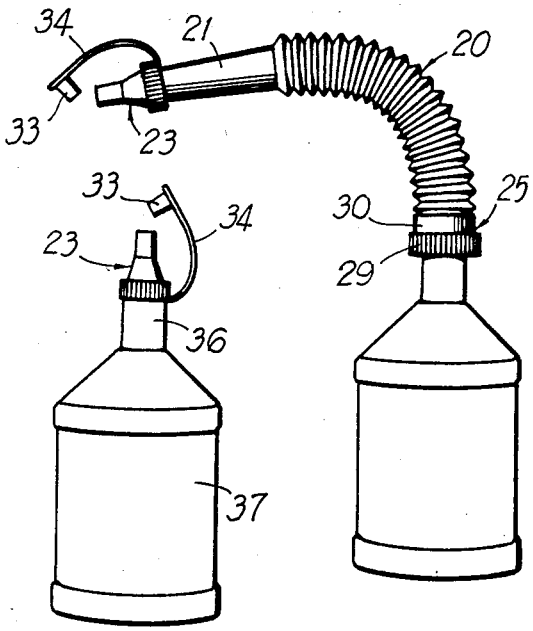

FIGS. 1, 2, and 6 show the adapter 25 in one position of use where the sleeve portion 29 of largest diameter is arranged uppermost and the sleeve portion 30 is arranged lowermost. In FIGS. 5, 7 and 9, the adapter 25 is reversed end-for-end.

Figure 4:
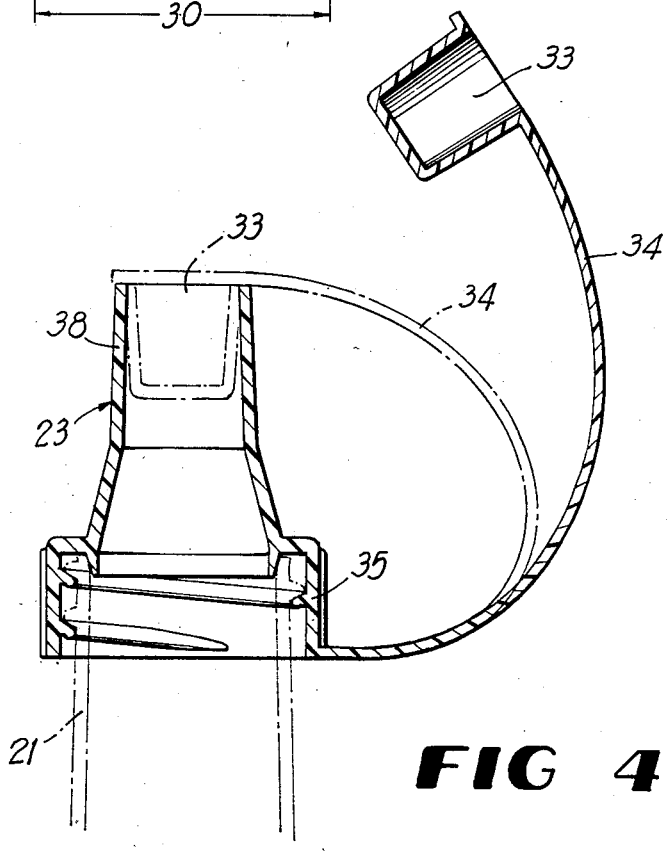
FIG. 4 is a fragmentary vertical section taken through an extension cap employed with the pouring spout.

The previously-mentioned extension cap 23 includes a closure plug 33 attached by a flexible strap 34 to an internally threaded sleeve portion 35 of the extension cap adapted for coupling with the threaded terminal 22 of the pouring spout 20 or with the neck 36 of a container 37 shown in FIG. 8. The closure plug 33 is adapted to fit snugly in the outlet end portion 38 of the extension cap 23, FIG. 4. Thus, the extension cap may be employed in two ways, first, as an extension and closure for the pouring spout 20 and as a pouring extension and closure for the threaded neck 36 of container 37, FIG. 8.

Preferably, the periphery of the adapter sleeve portion 29 is knurled as shown for ease of grasping and turning with the fingers.

While certain standard dimensions have been stated for the threaded portions of the adapter 25, it should be understood that the invention is in no way limited to these dimensions or sizes and the adapter 25 can be constructed for coupling with containers and pouring spouts whose threaded components have different diameters from those stated herein.

In essence, the invention provides a universal pouring spout for diverse liquid containers including a double-ended threaded adapter between the pouring spout and container outlet, which needs only to be reversed end-for-end to adapt the spout to all of the most commonly used plastic bottles. It should be understood that the end of the center threaded sleeve 26 away from the threaded terminal 24 of the pouring spout 20 can be coupled with a 28 MM diameter threaded outlet of any liquid container possessing an outlet of that size.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A universal pouring spout for containers having externally threaded outlets of diverse diameters comprising a flexible elongated pouring spout body portion having an externally threaded terminal at its rear end, and a double-ended multi-threaded adapter for threadedly coupling said threaded terminal with the threaded outlet of a container, said adapter including a center internally threaded sleeve of constant diameter opening through both end faces of the adapter, and first and second internally threaded sleeve portions on the adapter at opposite ends thereof in surrounding spaced concentric relationship to the center sleeve, said first and second sleeve portions having different diameters and each being of larger diameter than said center sleeve, and a median wall on the adapter serving to integrally join the center sleeve and said first and second sleeve portions.

2. A universal pouring spout for containers as defined in claim 1, and a forward end terminal of the pouring spout body portion being externally threaded, and an internally threaded extension cap for the pouring spout body portion adapted to be coupled with said forward end terminal thereof and also adapted to be coupled to the threaded neck of a container whose neck diameter is compatible with the extension cap.

3. A universal pouring spout for containers as defined in claim 2, and the extension cap having a liquid outlet end portion and a tethered closure plug for said outlet end portion on the extension cap.

4. A universal pouring spout for liquid containers comprising a pouring spout body portion, and an end-for-end reversible threaded adapter for coupling a threaded terminal of the pouring spout body portion with a threaded outlet of a liquid container, said adapter including an interior threaded sleeve of uniform diameter from end-to-end of the adapter, and a pair of exterior threaded sleeve portions of differing diameters each larger than the diameter of the interior sleeve and each surrounding the interior sleeve in spaced concentric relationship thereto.

5. A universal pouring spout for liquid containers as defined in claim 4, and the adapter having parallel end faces and the end faces being defined by corresponding ends of the interior sleeve and said exterior sleeve portions.

6. A universal pouring spout for liquid containers as defined in claim 5, and a transverse wall on the adapter substantially midway between its end faces and serving to integrally join the interior sleeve and the exterior sleeve portions.

7. A universal pouring spout for liquid containers as defined in claim 6, and an interior open-ended liquid conduit element carried by said transverse wall and being disposed inside of the interior sleeve.

* * * * *